US009392677B2

(12) United States Patent
Rudoy et al.

(10) Patent No.: US 9,392,677 B2
(45) Date of Patent: Jul. 12, 2016

(54) METHOD FOR GENERATING RADIATION AT RESONANT TRANSITIONS OF METAL ATOMS

(71) Applicants: Igor Georgievich Rudoy, Moscow (RU); Viktor Aleksandrovich Dolgikh, Moscow (RU); Leonard Pavlovich Menakhin, Moscow (RU); Akhat Zinurovich Nusratullin, Dolgoprudnyj (RU); Arkadij Matveevich Soroka, Moscow (RU)

(72) Inventors: Igor Georgievich Rudoy, Moscow (RU); Viktor Aleksandrovich Dolgikh, Moscow (RU); Leonard Pavlovich Menakhin, Moscow (RU); Akhat Zinurovich Nusratullin, Dolgoprudnyj (RU); Arkadij Matveevich Soroka, Moscow (RU)

( * ) Notice: Subject to any disclaimer, the term of this patent is extended or adjusted under 35 U.S.C. 154(b) by 175 days.

(21) Appl. No.: 14/373,695

(22) PCT Filed: Jan. 22, 2013

(86) PCT No.: PCT/RU2013/000046

§ 371 (c)(1),
(2) Date: Jul. 22, 2014

(87) PCT Pub. No.: WO2013/112074

PCT Pub. Date: Aug. 1, 2013

(65) Prior Publication Data

US 2015/0028767 A1 Jan. 29, 2015

(30) Foreign Application Priority Data

Jan. 27, 2012 (RU) ..... 2012101983

(51) Int. Cl.

| | |
|---|---|
| ***H05B 41/16*** | (2006.01) |
| ***H05B 41/30*** | (2006.01) |
| ***H05B 41/24*** | (2006.01) |
| ***H01J 61/20*** | (2006.01) |

(Continued)

(52) U.S. Cl.

CPC ..... *H05B 41/30* (2013.01); *H01J 61/20* (2013.01); *H01J 61/72* (2013.01); *H05B 41/24* (2013.01); *H05B 41/28* (2013.01); *H01J 61/70* (2013.01)

(58) Field of Classification Search

CPC ..... H01J 61/20; H05B 41/30
USPC ..... 315/246, 360
See application file for complete search history.

(56) References Cited

U.S. PATENT DOCUMENTS 2,194,300 A * 3/1940 Found ..... H01J 61/52 313/115
2,473,642 A * 6/1949 Found ..... H01J 61/72 313/572

(Continued)

FOREIGN PATENT DOCUMENTS

RU 2237390 C2 9/2004

*Primary Examiner* — Thuy Vinh Tran
(74) *Attorney, Agent, or Firm* — Andrew W. Chu; Craft Chu PLLC

(57) ABSTRACT

The invention relates to methods for generating radiation at resonance transitions of metal atoms in mixtures of inert gases and metal vapors that are excited by an arc electric discharge. The technical effect of the claimed invention is raising the efficacy and service life of radiation sources at metal atom resonance transitions, which are excited by a low-pressure arc discharge. The technical effect is achieved due to that, according to a method for generating radiation at resonance transitions of metal atoms in mixtures of inert gases and metal vapors, which method includes exciting mixtures of inert gases and metal vapors by a high-frequency alternating longitudinal electric discharge, a discharge is excited by essentially rectangular current pulses with an off-duty ratio not more than 2.0 and duration not exceeding the efficient life-time of resonance state of the radiating metal atom.

5 Claims, 1 Drawing Sheet

(51) Int. Cl.

| | |
|---|---|
| ***H01J 61/72*** | (2006.01) |
| ***H05B 41/28*** | (2006.01) |
| *H01J 61/70* | (2006.01) |

(56) References Cited

U.S. PATENT DOCUMENTS

| | | | | |
|---|---|---|---|---|
| 2,824,985 | A * | 2/1958 | Foulke | H01J 17/066 313/54 |
| 3,936,772 | A * | 2/1976 | Sucov | H01S 3/036 359/342 |
| 4,101,807 | A * | 7/1978 | Hill | H05B 41/36 315/116 |
| 6,441,564 | B1 | 8/2002 | Gu et al. | |
| 6,614,192 | B1 | 9/2003 | Noone et al. | |
| 2005/0035711 | A1 | 2/2005 | Spielman et al. | |
| 2009/0026965 | A1 * | 1/2009 | Van Den Broek | H01J 61/28 315/115 |

* cited by examiner

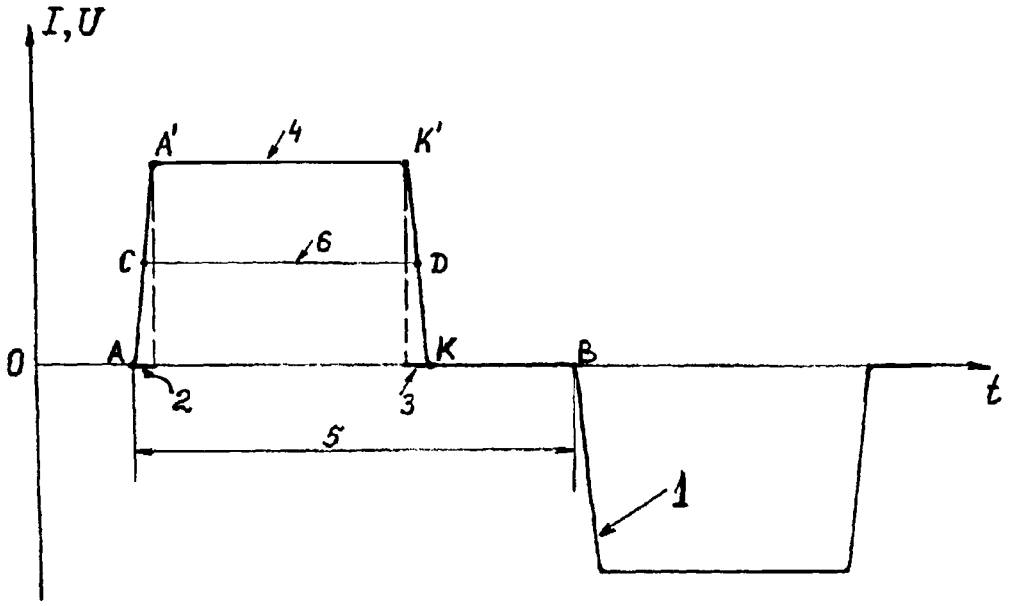
I,U
A'
4
K'
C
6
D
0
A
K
B
t
2
3
5
1

METHOD FOR GENERATING RADIATION AT RESONANT TRANSITIONS OF METAL ATOMS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The claimed technical solution relates to methods for generating radiation at resonance transitions of metal atoms in electric-discharge excited mixtures of inert gases and metal vapors and may be of interest for applications in photochemistry, microelectronics, ecology (purification of water and air), lighting engineering (fluorescent lamps) and other fields.

2. Description of Related Art Including Information Disclosed Under 37 CFR 1.97 and 37 CFR 1.98.

Electronic transitions between the ground state and first excited states of metal atoms are, potentially, highly efficient sources of narrow-band radiation in the ultraviolet (UV) and visible spectrum fields, when discharge-excited. Radiation in the UV is generated, first of all, by excited mercury atoms (wavelengths of resonance transitions $6^1P_1$-$6^1S_0$, $6^3P_1$-$6^1S_0$ are, approximately, 185 nm and 254 nm), the known Na duplet $5^2P_{1/2}$-$3^2S_{1/2}$ (589.6 nm) and $5^2P_{3/2}$-$3^2S_{1/2}$ (589.0 nm) corresponds to the visible spectrum. The resonance radiation of these two metal atoms is of main interest and is frequently used in applications.

In this connection, methods of exciting the above-said transitions in electric discharges (glow and arc discharges, those of low and high pressures, etc.) have been studied in detail; the most efficient parameters have been achieved for low-pressure arc discharges in mixtures of mercury or sodium atoms and inert gases. The excitation of resonance states and the discharge optical properties for mercury and sodium (as well as for vapors of other metals) are similar ([1]: Rokhlin, G. N. "Discharge Sources of Light". 2nd Edition, reworked and supplemented.—M.: Energoatomizdat, 1991, 720 pp.). A detailed description of the optical properties of discharge in mercury and a mixture of mercury and argon, that takes into account radiation reabsorption, is presented, for example, in the review ([2]: Fabricant, V. A. "Some Issues of gas discharge optics". UFN, 1947, V. 32, Issue 1, pp. 1-25). It has been shown in experiments and theoretical calculations [1,2] that under optimal conditions the efficiency of exciting low resonance and metastable levels by an electric discharge may reach approx. 75% for mercury atoms and more than 80% for sodium atoms, which makes the respective discharge metal-vapor lamps, first of all mercury-vapor lamps and sodium-vapor lamps, a prospective radiation source. Methods for exciting a discharge in such lamps are, on the whole, analogous to each other, the main differences, including structural ones, are associated with temperature at which optimal pressure of metal saturated vapors is realized.

A method for generating radiation at resonance transitions of a metal atom (mercury) is known that includes excitation of low-pressure mixtures of inert gases and metal atom by an alternating longitudinal electric discharge of industrial frequency (50 Hz) ([1]). This excitation method is used, apart from other things, in commonly known fluorescent mercury-vapor lamps [1]. As the metal atom source the known method uses metal mercury (metal sodium) kept at a certain temperature (corresponding, as a rule, to saturated metal vapor pressure of approx. 0.3÷1 Pa), and as an inert gas argon or an argon-neon mixture is used at a pressure of several hundreds of Pa. A metal-vapor lamp is, as a rule, a cylinder having a diameter ranging from 15 to 50 millimeters and a length of 0.3÷1.5 meters; the discharge operating temperature, which corresponds to the metal vapor optimal concentration, is approx. 45° C. for mercury and approx. 280° C. for sodium.

Under the above-said conditions an efficiency of generating UV-radiation by mercury atoms is rather high—a real efficiency of transforming the discharge energy into radiation of a resonance transition of a mercury atom at 254 nm may reach 25%, and a luminous efficacy of fluorescent mercury-vapor lamps according to the known method may reach 70 lm/W, that of sodium lamps—200 lm/W. The use of alternating electric current of industrial frequency (i.e., current which direction is changed for the opposite one every 10 milliseconds) for exciting a discharge enables practically completely preclude migration of positively charged ions (and, as a result, atoms) of mercury to a "instant cathode" and instability of radiation along the tube length. Furthermore, if quarts of high purity or other materials transparent in the field of 185 nm are used for making tubes of mercury-vapor lamps, up to 6% of the power involved in a discharge is emitted additionally, and, thus, a total generation efficiency of the UV-radiation in a mercury-vapor lamp according to the known method may reach approx. 30%.

But the efficiency of the known method is far from maximum possible values; furthermore, the known method is ecologically dangerous for mercury-vapor lamps, since it is necessary to recycle significant quantity of mercury which is in the liquid state in the lamp and quickly vaporizes at the room temperature, when the lamp life is over or the lamp is damaged. Furthermore, an electric discharge lights up and terminates in each half-period at 50 Hz frequency of alternating current (since, in the absence of an electric field, an electron life-time in the discharge is fractions of a millisecond), which requires relighting of a discharge in each cycle and reduces the electrode lifetime significantly, and also causes significant fluctuations of the radiation power. Moreover, when a small voltage is supplied to the lamp, the excitation efficacy of a mercury (sodium) atom is low, and energy supplied to the discharge transforms into heat practically in full due to elastic losses in collisions of electrons with atoms, which reduces not only the efficiency, but also the possible lamp radiation power (since a temperature of the lamp walls is limited due to quick rise in pressure of saturated metal vapors when temperature increases).

The closest technical solution (prototype) is a method for generating radiation at resonance transitions of metal atoms in a longitudinal high-frequency arc discharge of low pressure, which excites mixtures of inert gases and metal vapors. This method is studied most closely in respect of arc mercury-vapor lamps, first of all for amalgam mercury-vapor lamps ([3]: Kostyuchenko S. V., Kuzmenko M. Ye., Pecherkin V. Ya. "Study of operation of powerful amalgam sources of low-pressure bactericide radiation at the frequency of 40 kHz". The electronic journal "Studied in Russia", 2000, V. 3, pp. 1365-1372; http://zhurnal.ape.relarn.rWarticles/2000/100.pdf).

For the typical conditions of using the known method with the quasi-sinusoidal pumping frequency in the range of 30-50 kHz the main temporary parameters of discharge plasma are: circular frequency of sinusoidal excitation $\omega \sim (2 \div 3) \cdot 10^5$ Hz reverse life-time of excited atoms (considering radiated photons reabsorption at optimal pressure of metal vapors—in the known method—mercury) $1/T^* \sim (0.5 \div 1) \cdot 10^5$ Hz, frequency of electron temperature relaxation in a discharge $1/T_e \sim (5 \div 7) \cdot 10^5$ Hz. Excitation of a discharge at a circular frequency exceeding the reverse life-time of excited atoms (and, moreover, reverse life-time of electrons in a discharge) results in that an electron concentration does not practically change during the pumping period, and both a concentration of radiating (excited) atoms and a radiation power change within the limits of $\pm(20 \div 30)\%$. Due to the non-linear dependence of an excitation rate on electron temperature $T_e$, this concentration approaches the value corresponding to maximum temperature $T_e$ during a period. At the same time a frequency of an electron temperature relaxation $1/T_e$ in a discharge is so high that in any moment $T_e$ corresponds to an applied field, and, as a result, a concentration of radiating particles in a high-frequency discharge is ensured at lesser average electron energy, that is at a lesser value of elastic losses, and, correspondingly, at a rise in the efficiency of electric energy transformation into light.

In particular, in [3], when a longitudinal electric discharge excited one and the same mixture of the inert gases (Ar/Ne) with mercury vapors in the tube with the inter-electrode's distance of 1450 mm, the radiation generation efficiency at the wavelength of ~254 nm was approx. 33.6% at the pumping frequency of 50 Hz and 39.5% at the pumping frequency of 40 kHz. Furthermore, at a high frequency current anode voltage drop is reduced, a lowering energy release in the anode region leads to an increase in the electrodes service life. Similarly to this, a lowering electron average temperature reduces a diffusion rate of atomic (molecular) ions to the tube walls, and bombardment of the walls by ions also defines to a considerable degree the service life of modern metal-vapor lamps.

Thus, the application of a longitudinal high-frequency quasi-sinusoidal discharge for generating radiation in an arc discharge in mixtures of inert gases and metal vapors enabled to raise its efficacy significantly, increase the service life of the electrodes and, correspondingly, the lamp on the whole, as well as ensure rather high stability of radiation in the current change period.

In the case of mercury-vapor lamps the use of amalgams as the mercury atom source radically increases the safety of these lamps. At the room temperature (and even up to 50÷60° C.) a pressure of mercury saturated vapors over the amalgams used in the mercury-vapor lamps is low, mercury in such an amalgam lamp is in the bound state practically completely, the lamp has, as the vapors, approx. 0.03 mg per lamp, and it is this quantity that may pass to the atmosphere if the lamp is broken, as compared to several milligrams of mercury (and more) in the "common" mercury-vapor lamps. Furthermore, the use of an amalgam mercury atom source enabled in the known method, without complicating the structure at the same mercury atom to raise the operation temperature of the gas mixture to approx. 100° C., as compared to approx. 45° C. in a lamp with metal mercury, i.e., increase the energy input and the linear power of the generated UV-radiation significantly.

However, the efficiency of metal-vapor lamps according to the known method is considerably lesser than potential possibilities of a low-pressure discharge in mixtures of inert gases and metal vapors, of interest is also an increase in the service life of metal-vapor lamps, first of all lamps with high linear power of radiation.

SUMMARY OF THE INVENTION

The technical effect of the claimed invention is an increase in efficacy and service life of radiation sources at resonance transitions of metal atoms that are excited in a low-pressure arc discharge.

The technical effect is obtained due to the fact that the method for generating radiation at resonance transitions of metal atoms in a low-pressure arc discharge includes excitation of mixtures of inert gases and metal vapors by an alternating longitudinal electric discharge of high frequency, the discharge excitation is carried out by, in essence, rectangular current pulses with the off-duty ratio not more than 2.0 and duration not more than the efficient life-time of a resonance state of the radiating metal atom.

The principal concept of the claimed technical solution is to ensure the same, as in the known method, discharge excitation power with the same (or close) excitation efficacy, but with a lesser concentration of electrons in the discharge plasma.

A significant role of electronic quenching of metal atoms excited states that lowers the efficacy of, first of all, powerful resonance lamps is known. For example, a low-current sodium lamp with a low electron concentration and artificial heating to an optimal, as to a sodium vapor concentration, temperature enabled to realize luminous efficacy up to 400 lm/W ([1]), which is twice as high as in comparatively powerful sodium lamps. Similar to it, the reduction of high-frequency discharge current in an amalgam mercury-vapor lamp from 3 A to approx. 1.5 A leads to the increase in radiation efficiency at approx. 254 nm from approx. 35% to 41-42% or 1.2 times ([4]: Pecherkin V. Ya. "Study of UV-radiation drop mechanisms and the service life of UV-radiation sources with a low-pressure mercury arc". Abstract of the thesis for Candidate of Physico-Mathematical Sciences. M.: MPhTI, 2007, 23 pp.). A further lowering of discharge current in an amalgam mercury-vapor lamp, as the authors of the claimed technical solution have found, enables to obtain efficiency more than 50% with current of approx. 0.5 A and independent heating of the amalgam. Here, we should also stress the analogy between the processes in low-pressure mercury-vapor lamps and sodium lamps that are excited by an arc electric discharge.

However, in the known variants an increase in efficiency involves a significant reduction of electric power consumption by an arc discharge and emitted light power, which is of no practical interest. It is necessary for practical purposes to raise radiation efficacy without lowering radiation power, which is realized in the claimed invention.

When a discharge is excited according to the prototype, voltage U and current I in a discharge are changed practically according to the sinusoidal law:

$$U=U_0 \sin(\omega t); I=I_0 \sin(\omega t+\phi) \quad (1),$$

at this a phase shift $\phi$ is minimum and even, according to ([3]) voltage and current are cophased, $\cos\phi \approx 1$ (more accurately, in the range from 0.92 to 0.98). In this case the power consumption W and electron concentration $N_e$ in the discharge plasma are:

$$W=U_0 I_0/2; N_e \sim I_0/U_0 \quad (2),$$

the second relation results from the formula for current density $j_0=\bar{e}N_e\mu\bar{E}_0$, where $\bar{e}$ is an electron charge, $\mu$ is electron mobility, $\bar{E}_0=U_0/L$ is field intensity in a discharge (L is an inter-electrode distance) taking into account a practically constant electron concentration in a discharge for high-frequency pumping.

Let's assume that the same pumping power may be realized with the use of essentially rectangular current pulses for the same composition of the gas mixture, the same voltage $U_0$ and the off-duty ratio of alternating pulses G. In essence, the rectangular shape of the pulses means that current (or voltage) rise and drop time from zero to the value being 90% of the maximum (and again to zero) in every separate pulse is significantly lesser than the pulse duration, for example, a total rise and drop time does not exceed 10-15% of the total pulse duration. In this case the off-duty ratio of pulses is equal to relation of the time between the leading edges of pulses having different polarities to the duration of a separate pulse (for example, in half-height).

For the above mode the discharge pumping power is:

$$W=U_0I_1/G \quad (3),$$

where $I_1$ is the current amplitude of essentially rectangular pumping pulses (this equation may be considered also as the formal definition of the off-duty ratio, provided electric power consumption of a discharge is defined separately). By comparing the expressions (2) and (3), with due regard to similar electron mobility at similar intensity of an electric field, we can find the relation between an electron concentration in a discharge when pumped by essentially rectangular pulses $n_e$ and according to the prototype:

$$n_e=N_e\cdot(G/2) \quad (4)$$

Thus, if, provided essentially rectangular pulses are used with the off-duty ratio G<2, it could be possible to realize the same discharge pumping power at the same (or greater) voltage as in the prototype, then an electron concentration in a discharge will be reduced. And maintenance of voltage in the discharge means that excitation efficiency of radiating levels in the pumping variant considered will be not less than in the known method, and, as a consequence, generation efficacy of resonance radiation will be increased. As a result, the same radiation power (and this is a key characteristic of a lamp apart from its efficacy) may be obtained with lesser pumping power, that is with even lesser current (electron concentration), which further increases the lamp efficiency.

Moreover, a lesser concentration of electrons and, correspondingly, ions automatically ensures lesser ion bombardment of the tube walls, which increases its service life. Similarly, a lesser amplitude value of discharge current lowers load exerted on the electrodes, thus increasing their service life.

However, it was not possible to realize the above mode of exciting a low-pressure longitudinal arc discharge. As a rule, pumping of an arc discharge by essentially rectangular pulses with a low off-duty ratio (G<2) results in significant reduction of discharge voltage (in comparison with sinusoidal pumping), and the efficiency of generating resonance radiation was not increased. It is also necessary to take into account that at similar voltage amplitude in a discharge and a low off-duty ratio of essentially rectangular pulses an average electron temperature for the period is higher than during sinusoidal pumping, and, thus, a share of elastic losses is also higher (per "one electron").

BRIEF DESCRIPTION OF THE DRAWINGS

The FIGURE is a graph illustration of the general excitation pulses shape according to the invention.

DETAILED DESCRIPTION OF THE DRAWINGS

The authors of the claimed technical solution have managed to define experimentally a range of conditions under which discharge excitation by essentially rectangular pulses with a low off-duty ratio takes place at practically the same voltage as at high-frequency sinusoidal pumping. As the authors have determined, it is necessary that the duration of an individual pumping pulse is shorter than the efficient (considering reabsorption of radiation and mixing resonance and meta-stable levels by discharge electrons) life-time of a radiating resonance state. Under the said conditions a duration of an interval between successive pulses of different polarities also does not exceed the efficient life-time of a radiating resonance state.

The life-time of a radiating resonance state may be determined both by solving the corresponding radiation transfer equations and the kinetics of metal atom excited levels, or experimentally—by measuring time dependence of radiation power of a metal-vapor lamp after "sharply" switching off excitation or by measuring radiation variations during the pumping period.

The typical life-time of a $6^3P_1$ resonance level in arc mercury-vapor lamps is from 10 to 20 microseconds (here radiation reabsorption is of importance, since a spontaneous life-time of this level is approx. 0.1 microseconds), the typical life-time of a duplet in arc sodium lamps is from 5 to 10 microseconds.

The use of pumping pulses of longer duration results, as stated above, in a lowered discharge voltage (and excitation efficacy). Similarly to it, the use of an off-duty ratio close to 1, i.e., quick switching of current direction practically without an interval between pulses of different polarities, has proved to be equivalent to the continuous pumping mode with corresponding drop of inter-electrode voltage and excitation efficacy. In its turn, the use of an off-duty ratio close to 2 of essentially rectangular pulses creates an excitation mode close to the sinusoidal mode with the same or even slightly lower efficacy.

Thus, the duration of a separate, essentially rectangular arc discharge excitation pulse in a low-pressure mercury-vapor lamp is not more than 12÷15 microseconds, preferably 3-7 microseconds, since generation of shorter pulses with corresponding shortening of edges already provides no advantages, but represents a more complicated technical problem. The duration of a separate, essentially rectangular excitation pulse in a low-pressure sodium lamp is not more than 7-10 microseconds, preferably 3÷5 microseconds. The preferable pulse off-duty ratio is 1.4-1.6.

Hereinafter, the invention will be explained on the example that does not limit the invention in any way and with reference to the accompanying drawing wherein:

The FIGURE general excitation pulses shape according to the invention; 1—shape of discharge current (voltage), 2 (line AA')—leading edge of a current pulse, 3 (line KK')—trailing edge of a current pulse, 5 (line AB)—time interval between pulses of different polarities, 6 (line CD)—duration of a separate excitation pulse (in half-height).

Based on designations on FIG. 1, pulse off-duty ratio G=AB/CD, and for pulses with short edges, when AA', KK'<<AK (A'K'), certain arbitrariness in determining duration of a not correctly rectangular pulse does not result in a significant change in off-duty ratio. For example, a pulse having the shape of isosceles trapezoid with AA'=KK'=0.04·AK, when the off-duty ratio, as determined "by the base" ($\hat{G}$=AB/AK), is 1.5, the off-duty ratio, as determined "by half-height" ($\hat{G}$=AB/CD) is approximately 1.57 (the difference is less than 5%).

EXAMPLE

An amalgam mercury-vapor lamp with the inter-electrode distance of 106 centimeters was excited by a longitudinal electric discharge in two modes: with high-frequency sinusoidal pumping at the frequency approx 0.31 kHz and with pumping according to the invention.

The duration of a separate, essentially rectangular pulse was 4.2 microseconds in half-height with a duration of current (voltage) leading and trailing edges not more than 0.15 microseconds. The frequency of generating one polarity pulses was 80 kHz which corresponds to the off-duty ratio of approx. 1.5. The pressure of the inert gas mixture Ne/Ar=30%/70% was approx. 220 Pa.

An optimum pressure of mercury vapors was selected for the two modes; it was approx. 1 Pa and slightly higher for sinusoidal pumping wherein the operation temperature of the amalgam used was approx. 102-104° C., for pumping according to the invention the optimum temperature of the amalgam was 96-98° C.

An oscilloscope used for registering signals enabled to determine values of current, voltage and radiation power at $\lambda$=254 nm every 0.06 microseconds. The pumping power was determined by integrating instantaneous value of discharge power consumption, an average radiation power was determined similarly.

With the sinusoidal pumping power approx. 205 W and the discharge voltage amplitude of 134-135 V (current amplitude ≈3.15 A) the measured radiation power was ≈74 W, which corresponded to the mercury-vapor lamp efficiency of approx. 36%. When using pumping by essentially rectangular pulses having the above-said parameters and the voltage amplitude of 132-134 V, the radiation power was ≈73-74 W (current amplitude ≈2.1 A) with the pumping power of approx. 181 W, which corresponded to the efficiency of ≈40.7% (growth by ~13%, as compared to the high-frequency sinusoidal pumping). Radiation power variation for the period in the embodiment of the claimed technical solution does not exceed ±5%, as compared to ±30% with the high-frequency sinusoidal pumping.

When the duration of an essentially rectangular pulse was increased to 10 microseconds and the pulse off-duty ratio was maintained to be approx. 1.5 (the frequency of generating pulses of one polarity was ≈33.5 kHz), growth in the efficiency of an amalgam mercury-vapor lamp, as compared to the sinusoidal pumping, did not exceed ~3%, and the voltage amplitude in a pulse reduced to ≈130 V, and variations of light intensity for the period grew to ±20%.

Application of the claimed technical solution for exciting by arc discharge a powerful low-pressure mercury-vapor lamp provides radiation power equal to radiation power obtained with high-frequency sinusoidal pumping at the same discharge voltage and with current amplitude (and electron concentration) reduced by ≈35%, which would enable to increase the tube service life as well as the electrode service life significantly together with an increase in the resonance radiation generation efficiency 1.1-1.15 times.

It is necessary to mention that with a lesser concentration of electrons/ions in discharge plasma according to the claimed invention it becomes possible to reduce gas pressure in a low-pressure mercury-vapor lamp, since an ion flow to the wall is proportional to the product of an ion concentration and their ambipolar diffusion coefficient. It is known that efficacy and power of a mercury-vapor lamp increase with a decrease of inert gas pressure, which enables to further increase the efficiency and power of an arc mercury-vapor lamp according to the claimed invention without reducing its service life.

Thus, the authors of this application for a patent have managed to realize optimal, from the points of efficiency and service life, conditions for generation of resonance radiation by a low-pressure arc lamp with a mixture of inert gases and metal vapors, which is excited by a longitudinal electric discharge. The proposed technical solutions also enable to increase the service life of electrodes, the protective coating and the lamp on the whole. The claimed excitation conditions are essentially different from those used in the present time and, moreover, disprove the statement that the sinusoidal pumping mode at a frequency of several tens of kilohertz is optimal and more efficient than the use of quasi-direct current ([3], [5]: Drop P. C., Polman J. "Calculation on the effect of supply frequency on the positive column of a low-pressure Hg—Ar AC discharge". Journal Physics D: Applied Physics, 1972, V. 5, pp. 562-568), which enables to make the conclusion that the claimed technical solution complies with the criteria of "novelty" and "essential differences".

In order to fulfill some possible particular requirements, those skilled in the art may introduce changes into the above variants of exciting mixtures of inert gases with metal vapors by a high-frequency alternating longitudinal electric discharge with essentially rectangular current pulses, but without departing from the provisions protected by the claims. In particular, the claimed technical solution is also applicable for metal vapor lamps with non-cylindrical shape of a discharge (radiating volume), changed composition (component ratio) and/or a pressure of a gas mixture, etc.

We claim:

1. A method for generating radiation at resonance transitions of metal atoms in a low-pressure arc discharge, said method comprising:

exciting mixtures of inert gases and metal vapors by alternating longitudinal electric discharge, wherein the discharge is excited by essentially rectangular current pulses with an off-duty ratio less than or equal to 2.0 and a duration less than or equal to an efficient life-time of resonance state of a radiating metal atom, wherein said radiating metal atom is comprised of a mercury atom or a sodium atom.

2. The method according to claim 1, wherein the discharge is excited by the essentially rectangular pulses with an off-duty ratio in the range of 1.3 to 1.7.

3. The method according to claim 1, wherein a duration of a separate, essentially rectangular current pulse of one direction is less than or equal to 12 microseconds.

4. The method according to claim 1, wherein the discharge is excited by the essentially rectangular pulses with an off-duty ratio in the range of 1.4 to 1.6.

5. The method according to claim 1, wherein a duration of a separate, essentially rectangular current pulse of one direction is 3 to 7 microseconds.

* * * * *